United States Patent [19]

Görlitz

[11] 4,276,158

[45] Jun. 30, 1981

[54] SCREEN FOR A SCREENING MACHINE

[75] Inventor: Frank Otto Görlitz, Braunschweig, Fed. Rep. of Germany

[73] Assignee: Bühler-Miag GmbH, Braunschweig, Fed. Rep. of Germany

[21] Appl. No.: 127,405

[22] Filed: Mar. 5, 1980

[30] Foreign Application Priority Data

May 15, 1979 [DE] Fed. Rep. of Germany ..... 2919500

[51] Int. Cl.[3] ..... B07D 1/04

[52] U.S. Cl. ..... 209/255; 209/405

[58] Field of Search ..... 209/255, 316, 317, 352–356, 209/405

[56] References Cited

U.S. PATENT DOCUMENTS

| | | | |
|---|---|---|---|
| 965,683 | 7/1910 | Benson | 209/317 |
| 3,388,797 | 6/1968 | Herman et al. | 209/317 X |
| 3,719,277 | 3/1973 | Michael | 209/317 X |

*Primary Examiner*—William A. Cuchlinski, Jr.
*Attorney, Agent, or Firm*—Michael J. Striker

[57] ABSTRACT

The exchangeable planar screen includes a screen frame having an open lateral wall and a collecting floor and, above the floor, a meshed fabric; a duct unit assembled of at least two separate and intersecting channels adjoins the open wall of the frame whereby one channel is flush with the collecting floor and the other channel has a funnel-like inlet section adjoining the edge of the fabric and is directed perpendicularly relative to the one channel.

8 Claims, 3 Drawing Figures

SCREEN FOR A SCREENING MACHINE

BACKGROUND OF THE INVENTION

The present invention relates in general to screening machines, and in particular to an exchangeable planar screen for such machines including a screen frame arranged in a mounting support, a collecting floor and a fabric secured to the screening frame to act as a screening surface.

In screening cereal grain material to separate coarse foreign substances such as weeds, little cords, small pieces of rock and soil as well as fine foreign particles such as sand, small grains or broken grains, screening machines are employed which include screens having wide mesh fabric or so-called coarse screens as well as subsequent screens having fine meshed fabric, the so-called sand screens. Coarse foreign particles passing over the coarse screen are discharged through an outlet whereas the treated material passing through the coarse screen is fed to the subsequent sand screen or to a plurality of parallel connected sand screens arranged downstream of the flow of the treated material. The additional separation performed on the latter results in the provision of the cleaned product passing over the sand screens while fine foreign particles pass through the sand screens, the latter being guided to corresponding outlets whereby the clean product is supplied to a conveyor or if the separation of fine dust and light particles such as wheat seeds, shells, small straw particles and finely crushed grains is desired, the cleaned product is fed to a wind sifting machine where the fine foreign particles are sucked out or collected in containers and removed.

The above-described screening process is suitable for grain material having a larger grain size such as for example wheat, rye, barley, oats, corn or rice, but the aforementioned screen arrangement is unsuitable for treating grain material having fine grains such as for example rape seeds, sorghum or milo inasmuch as in the case of such fine grains the screening of fine foreign particles takes no effect. Accordingly, in treating such fine grains it is possible to eliminate only coarser foreign components while the fine grain material passes through the sand screen. Any coarser foreign particles which are larger than the grain material such as burdock in the case of rape seeds, pass over the screen. As a consequence, in the above-described screening machines the outlets for discharging fine foreign particles only now discharge the cleaned product whereas the outlets normally discharging the cleaned large grain material to a conveyor or to an air sifter would now discharge coarse foreign particles of smaller size. In order to avoid this situation and for adjusting conventional screening machines for the treatment of the aforementioned fine grain cereals, it has been already devised in practice to cover the sand screen with metal sheets or blind floors and to use the coarse screens or screen only. This temporary adjustment, however, is disadvantageous because of the fact that respective screening surfaces can be loaded to a certain limit only and therefore the height of the processed layers must not exceed a certain limit. Moreover, for screening fine foreign particles it is necessary to provide a larger sand screening surface than for coarse screening surfaces and this relatively large sand screening surface remains in the case of processing fine grain material completely unused.

SUMMARY OF THE INVENTION

It is, therefore, a general object of the present invention to overcome the aforementioned disadvantages.

More particularly, it is an object of the invention to provide standard screening machines with means for removably mounting planar screens for separating fine foreign particles so that the screening machine is suitable not only for screening coarse grain material, but also for screening fine grain material whereby the employed screening surfaces are fully utilized.

Another object of this invention is to provide such an improved exchangeable screen which enables that, irrespective of the grain size of the processed grain material and of the admixed foreign particles, the separated components are discharged always from the same outlets of the screening machine.

In keeping with these objects, and others which will become apparent hereafter, one feature of the invention resides, in a screening machine, in the provision of an exchangeable planar screen including a screen frame having an open lateral wall and a collecting floor, a support for holding the frame in a plane sloping in a discharging direction toward the open wall, a fabric secured on the frame above the floor to act as a screening surface, and guiding means adjoining the fabric and the floor at the open lateral wall for separately guiding the screened material from the floor and larger foregin particles from the screening surface.

In the preferred embodiment of this invention, the guiding means includes a plurality of guiding channels crossing each other in the discharging direction and each having a discharge opening arranged in a plane which adjoins the plane of the floor, a part of the channels which is assigned for guiding the screened material has an inlet opening communicating with the floor, and the other part of the channels which is assigned for guiding the larger particles has respectively inlet openings separated from the floor and communicating with the screen surface. When a screening machine is to be adjusted for screening fine grain material it is now sufficient when each existing sand screen is replaced by a planar screen provided with a guiding means of this invention so that the guiding means guide the separated residual on the screen (foreign particles) and the material passing through the screen (cleaned product) to the outlets of the machine where the corresponding components are discharged even during the processing of large size grain material.

According to another feature of this invention the guiding means are either rigidly connected to the screen frame to form a single unit therewith or are created as a separated unit connectable to the open wall of the screen frame. In both cases the combined screen and the guiding means for use in processing fine grain material according to this invention has a working area which corresponds to conventional sand screens for processing coarser grain material so that both types of the screen can be interchangeably mounted in the machine.

According to still another feature of this invention, the guiding channels for the cleaned material and for the foreign particles are alternately arranged side-by-side to one another along the open wall of the frame whereby the channels assigned for discharging the large particles are directed perpendicularly to the feeding direction and have inlet openings adjoining the edge of the screen surface and being separated from the floor whereas the channels assigned for discharging the cleaned material extend substantially in the feeding direction and have inlet openings communicating with the frame floor and being separated from the inlet openings of the adjoining channels. The outlet openings of the respective groups of guiding channels are arranged in two mutually perpendicular planes. In a preferred embodiment of this invention, the succession of the funnel-like openings of the upright guiding channels occupies the entire length of the adjoining edge of the screening surface whereby the upright channels divide the floor of the frame into the discrete channels extending in the feeding direction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
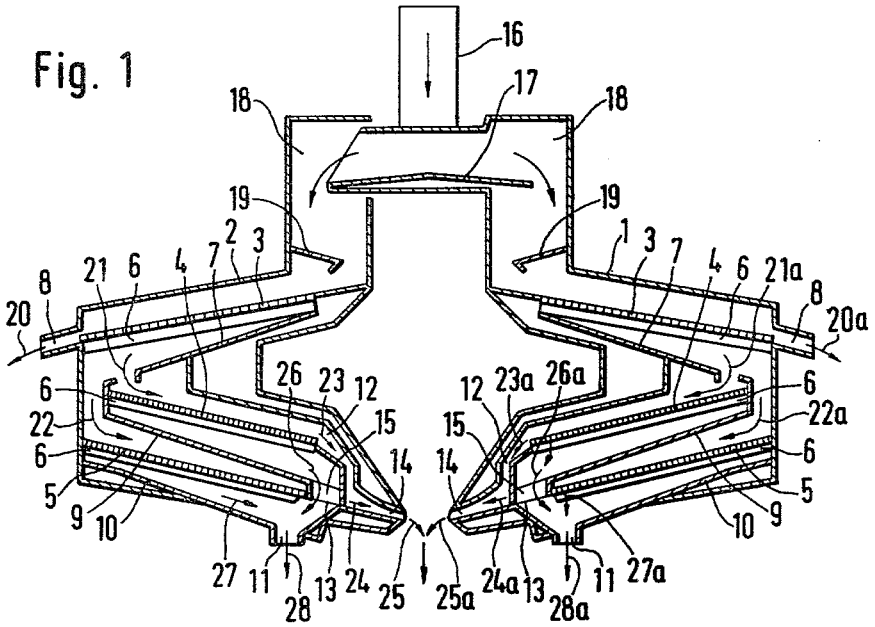
FIG. 1 is an axial cross section of a schematically illustrated screening machine applicable for exchangeable planar screens of this invention.

Referring firstly to FIG. 1, the screening machine for cleaning corn or other cereals has two juxtaposed housing parts 1 and 2 mirror-symmetrically arranged about a center axis and being connectable in a conventional manner to a vibrator which imparts to the entire housing a rocking movement. Each of the two housing parts is provided with mounting supports for exchangeably mounting three superimposed screens, namely a coarse screen 3 for screening coarse impurities (coarse foreign particles) and two sand screens 4 and 5 for screening fine impurities (fine foreign particles). All mounting supports for exchangeably holding respective screens 3, 4 and 5 are designated by reference numeral 6. The coarse screen 3 is provided with a distributing floor 7 which uniformly distributes the grain material passing through the screen and discharges the preliminarily cleaned material on the first sand screen 4 and therefrom on the second sand screen 5. Each housing part 1 and 2 is provided with an outlet 8 adjoining the downstream edge of the coarse screen 3 for discharging the separated coarse foreign particles. Below respective sand screens 4 and 5 are arranged sloping floors 9 and 10 which collect the fine foreign particles and discharges same at the outlet 11 at each of the housing parts 1 and 2. The downstream edge of the upper sand screen 4 adjoins a channel 12 which communicates also with a channel 13 leading to the downstream edge of the lower sand screen 5 and discharges the cleaned grain material through outlet 14. A chute 15 occupies only a portion of the edge of the floor 9 so that the cleaned material from the screen 5 can flow without obstacles to the discharge opening 14.

Both housing parts 1 and 2 have a common intake port 16 and a common distributing descent plate 17 which uniformly distributes the grain material to be cleaned to both inlet chutes 18. A distributing plate 19 in each of the chutes 18 serves for the uniform distribution of the grain material over the entire cross section of the assigned coarse screen 3.

If heavy corn or other material having coarse grains is to be cleaned in the screening machine, both coarse screens 3 and the sand screens 4 and 5 are planar screens of a conventional configuration which are mounted in the support 6 in the illustrated manner to discharge the separated coarse and fine foreign particles from the treated grain material. As it has been described above, the coarse foreign particles from each coarse screen 3 are discharged through the assigned outlet 8 in the direction of arrow 20 whereby the cleaned material passing through the screens is first collected on the sloping floor 7 and discharged on the sand screens 4 and 5 in the direction of arrows **21*a* and 22*a*. The separated larger grains passing over the screens are discharged from the screen 4 directly into the channel 12 in the direction of arrow 23*a* and from the lower sand screen 5 the cleaned grain particles are discharged via channel 13 into the channel 12 and therefrom through the outlets 14 in the direction of arrows 25 and 25*a*. The fine foreign particles passing through the sand screens 4 and 5 on the sloping floor 9 bypass the chute 15 in the passage 13 and join the screened fine particles from the bottom 10 of the lower sand screen 5 to be discharged through the outlet 11 in the direction of arrows 28 and 28*a***.

Figure 3:
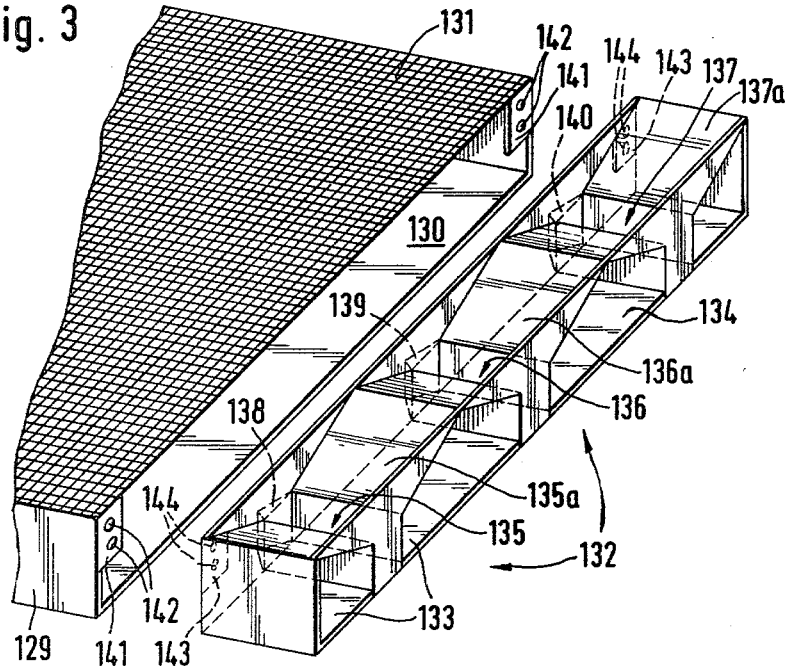
FIG. 3 shows in an exploded view a modification of a planar screen of this invention having a detachable guiding means.
Figure 2:
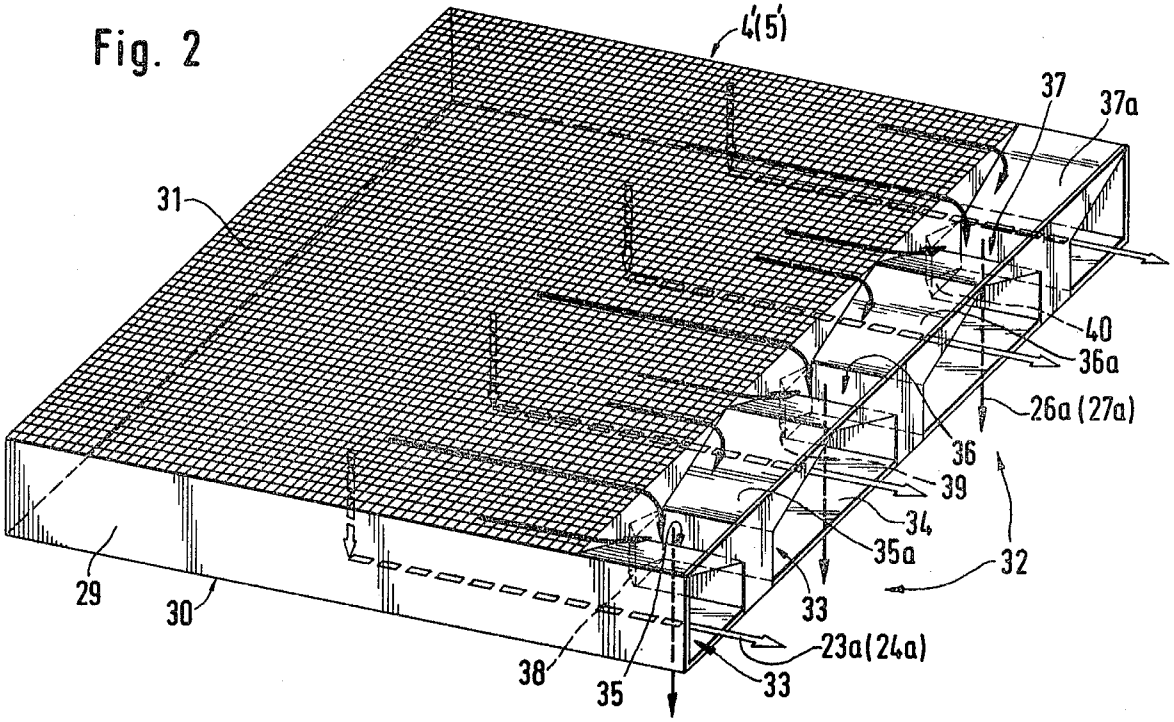
FIG. 2 is a perspective view of a screen of this invention provided with integrally connected guiding means.

If, however, instead of large size corn it is required to process in the screening machine grain material having fine grains such as, for example, sorghum, milo or rape seeds, the conventional sand screens 3 and 5 are removed from the machine and replaced by sand screens according to this invention as illustrated in FIGS. 2 and 3.

The sand screen 4' or 5' according to FIG. 2 includes a screen frame 29, a collecting floor 30 as well as a superimposed screening surface in the form of a fabric 31 having a desired meshed size. Along an open lateral side of the frame are provided guiding means 32 directly adjoining the corresponding edges of the screening fabric 31 and of the floor 30 and forming together with the frame 29 an integral unit. The guiding means 32 is constituted by two groups of crosswise directed channels, namely of channel group 33 including channels communicating with the floor 30 and extending in the feeding direction as indicated by arrows **23*a* and 24*a*; the other group is constituted by crosswise directed channels 35, 36 and 37 separating the channels 33 and extending in the direction of arrows 26*a* and 27*a* which are perpendicular to the feeding direction 23*a* and 24*a*. The inlet openings 35*a*, 36*a* and 37*a* of the perpendicular channels have a funnel-like configuration and are separated from the inlet openings of the channels 33 by upright partitions. The funnel-like inlet openings adjoint each other and thus extend successively over the entire length of the adjoining edge of the screening fabric 31. The effective cross sections of respective channel groups are dimensioned proportionally to the working area of the screening fabric 31. The upright partitions separating the upright channels 35 through 37 from the longitudinal channels 33 are provided on its inner side with deflecting noses 38, 39 and 40 which prevent the accumulation of the sifted material and uniformly distribute the same into respective longitudinal guiding channels 33**.

In processing the aforementioned small size grain cereals the coarse foreign particles are separated by the coarse screen 3 in the same manner as in the aforedescribed processing of large size grain material whereby the coarse foreign particles passing over the coarse screen 3 are discharged through the outlet 8 in the direction of arrow 20*a*. The grain material passing through the coarse screen 3 accumulates on the distributing floor 7 and is discharged therefrom on both sand screens 4' and 5' which separate finer foreign particles from the processed fine grain material such as, for example, rape seeds. In contrast to the setting of the machine for screening coarser grain material, in the screens according to this invention, the fine grains passing through the fabric 31 on the collecting floor 30 during the rocking movements of the housing parts 1 and 2 are discharged toward the guiding means 32 at the open wall 34 and pass through the inlet and outlet openings of the longitudinal channel 33 directly into the channel 12 in the direction of arrow 23*a* and the lower sand screen 5' discharges the cleaned material through channel 13 in the direction of arrow 24*a* into channel 12 and therefrom the cleaned fine grain material is discharged into the outlet 14 in the direction of arrow 25*a* on a conveyor or into an air sifter.

Foreign matters which are larger than the fine grains is discharged during the vibrations of the housings 1 and 2 from the surface of the fabric 31 in respective screen 4' (and 5') in the direction toward the guiding means 32 and drop first in the inlet funnels 35*a*, 36*a* and 37*a* and therefrom are discharged through the chute 15 in the intermediate part of channel 13 into the outlet 11. The same discharging process takes place in the lower sand screen 5' where the foreign particles slide through channels 35, 36 and 37 in the direction of arrow 27*a* directly into the outlet 11 and are collected in sacks or containers placed opposite the arrow 28*a*.

From the foregoing description it is apparent that by using the planar screens provided with duct means according to this invention the cleaned fine grain material and the separated foreign particles are discharged at the same outlets of the housing of the screening machine as in the case of processing cereals having coarser grains.

In the modification of this invention as illustrated in FIG. 3, by contrast to the embodiment of FIG. 2, the ducts or guiding means 132 are formed as separate units attachable to the screen frame 129. For the sake of clarity, both the duct or guiding means 132 and the screen frame 129 together with its collecting floor 130 and its screening fabric 131 are shown in an exploded view. In an assembled condition, both the screen frame 129 and the guiding means 132 are provided with mounting brackets 141 and 143 facing each other and being rigidly connected, for example, by welding to the assigned parts. Each bracket is provided with holes 142 and 144 for nonillustrated fastening screws. In this manner, both the guiding means 132 and the open wall portion of the screen frame 129 are rigidly but detachably connected to each other in the direction of movement of the processed material.

In both embodiments the intersecting channels of the guiding means and the corresponding partitions are made of thin walled metal sheets connected by welding. The longitudinally directed channel 133 extends over the entire width of the open wall of the screen frame 129 and its bottom wall 134 is flush with the collecting wall 130 of the screen frame. The three perpendicularly directed channels 135, 136 and 137 with respective inlet funnels 135*a*, 136*a* and 137*a* divide the channel 133 into a plurality of parallel channel portions. The side wall of the perpendicular channels 135 through 137 adjoining the screen fabric 131 is provided with distributing wedges 138, 139 and 140 for guiding the screened material. These wedges are also made of thin walled metal sheets connected to the upright wall by welding. The operation of the guiding means 132 is the same as the operation of guiding means 42 in FIG. 2.

The advantage of the novel planar screens of this invention is in the fact that conventional screening machines can be employed for processing different grain materials whereby the screening surface installed for screening fine particles can be utilized in a most advantageous manner also for screening fine grain material, thus achieving a higher screening efficiency than in conventional settings of standard screening machines. In addition, irrespective of the size of the grain material the cleaned product and the separated foreign particles are always discharged at the same outlets of the machine which feature is particularly important in the case when the cleaned product is transported to an air sifter which is installed directly in the corresponding outlet.

It will be understood that each of the elements described above, or two or more together, may also find a useful application in other types of constructions differing from the types described above.

While the invention has been illustrated and described as embodied in specific examples of exchangeable planar screens for use with screening machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed as new and desired to be protected by Letters Patent is set forth in the appended claims:

1. An exchangeable planar screen unit for use in a screening machine having an outlet for fine particles and an outlet for larger particles, said screen unit comprising a screen frame having an open lateral wall and a floor for collecting screened fine particles; a mesh fabric secured on said frame above said floor to act as a screening surface; duct means adjoining said fabric and said floor at said open lateral wall, said duct means including at least two separate channels crossing each other, one of said channels communicating with said floor for guiding the screened fine particles from said floor toward said outlet for larger particles, and the other channel communicating with said screening surface for separately guiding the larger particles remaining on said screening surface toward said outlet for fine particles.

2. A screen unit as defined in claim 1 wherein, said duct means is integrally connected to said screen frame.

3. A screen unit as defined in claim 1, wherein said duct means are detachably connected to said screen frame.

4. A screen unit as defined in claim 1, wherein said other channel has a funnel-like inlet portion adjoining the edge of said fabric.

5. A screen unit as defined in claim 4, wherein said duct means includes a plurality of first channels extending parallel to each other in said discharging direction and a plurality of said other channels extending between said first channels in a perpendicular direction.

6. A screen unit as defined in claim 5, wherein the inlet funnels of said other channels occupy the entire length of the adjoining edge of said fabric.

7. A screen unit as defined in claim 6, wherein the effective cross section of said first channels is larger than the cross section of said other channels.

8. A screen unit as defined in claim 1, further including a support for holding said frame in a plane sloping toward said open wall.

* * * * *